US006798721B2

(12) United States Patent
Ebi

(10) Patent No.: US 6,798,721 B2
(45) Date of Patent: Sep. 28, 2004

(54) ELECTRONIC TIMEPIECE

(75) Inventor: Akira Ebi, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/345,754

(22) Filed: Jan. 16, 2003

(65) Prior Publication Data

US 2003/0142589 A1 Jul. 31, 2003

(30) Foreign Application Priority Data

Jan. 24, 2002 (JP) ..... 2002-015935

(51) Int. Cl.[7] ..... G04C 19/00; G04B 37/00
(52) U.S. Cl. ..... 368/82; 368/84; 368/88
(58) Field of Search ..... 368/82–84, 88, 368/239, 242, 281, 299

(56) References Cited

U.S. PATENT DOCUMENTS 4,391,531 A * 7/1983 Yokota et al. ..... 368/239
4,624,529 A * 11/1986 Dorfman ..... 349/142
4,985,878 A * 1/1991 Yamada et al. ..... 368/88
5,647,121 A * 7/1997 McLellan et al. ..... 29/840
5,787,054 A * 7/1998 Yasukawa et al. ..... 368/204

* cited by examiner

*Primary Examiner*—Vit W. Miska
(74) *Attorney, Agent, or Firm*—Adams & Wilks

(57) ABSTRACT

An electronic timepiece adapted to minimize a horizontal slippage of contact terminals when a display unit housing is diagonally fitted in a case. A liquid crystal panel, and an electroluminescence panel adapted to illuminate and secured to a rear surface of the liquid crystal panel are provided. A display unit housing retains the liquid crystal panel and electroluminescence panel. The display unit housing has guide holes for inserting electric terminals thereinto and holding the same therein. The electric terminals are inserted into the guide holes. Each of the electric terminals is connected at one end thereof to a rear surface of the electroluminescence panel, and at the other end thereof to a circuit board. The guide holes in the display unit housing have bores thereunder the diameter of each of which is larger than that of each of the guide holes so as to prevent a force exerted on the electric terminals when the electric terminals are inserted into the guide holes during an operation for diagonally fitting the display unit housing into a case with the liquid crystal panel, electroluminescence panel and electric terminals in a firmly combined state from causing the electric terminals in the mentioned state inserted into the display unit housing to slip in a horizontal direction.

3 Claims, 3 Drawing Sheets

ELECTRONIC TIMEPIECE

BACKGROUND OF THE INVENTION

This invention relates to an electronic timepiece in which the reliability of the electrical connection of terminals made when a display unit is fitted diagonally into a housing is improved.

The construction of a related art electronic timepiece is shown in FIG. 5. The related art electronic timepiece generally has a structure in which a display unit 511 formed by holding in a housing 515 a liquid crystal panel 516, an electroluminescence panel (which will hereinafter be referred to as "EL panel") 517, and a coiled spring 514 electrically connecting the EL panel 517 and a circuit board 512 together; and a driving circuit mounted with an integrated circuit and electric elements so as to supply an electric signal to the liquid crystal panel 516 and EL panel 517 are connected together by conductive rubber, a photoseal and a coiled spring.

In the electronic timepiece of such a construction, the display unit 511 is combined with the circuit board 512 as the display unit 511 is lowered vertically with respect the circuit board 512, so that a load is imparted to contact terminals, such as the conductive rubber 518 and coiled spring 514 vertically as well. Therefore, positions of the coiled spring and conductive rubber do not horizontally shift when these parts are bent.

In order to fit the display unit into a case in the related art electronic timepiece after the display unit is set diagonal with respect to the case so as to prevent the display unit from contacting other parts, such a display unit fitting operation is carried out as the display unit is inclined. Therefore, a load is imparted to the contact terminals diagonally, and the coiled spring and conductive rubber are locally deformed or caught on a free end of a terminal guide of the housing. When the display unit is further combined with the resultant product, a load is imparted vertically to a portion between the free end of the terminal guide of the housing and contact terminals. Consequently, a level of the frictional force of the driving circuit and electric terminals becomes higher than that of a force by which the electric terminals can move in a horizontal direction owing to the elastic deformation thereof, so that the display unit is fitted in the case with the electric terminals including coiled springs and conductive rubber slipped in the horizontal direction. This gives rise to problems of a slippage of the terminals from a predetermined pattern of the driving circuit, and a failure to electrically connect the driving circuit to the liquid crystal panel and EL panel.

SUMMARY OF THE INVENTION

The present invention has been made in view of these circumstances, and is to provide an electronic timepiece in which a horizontal slippage of contact terminals occurring when a contact terminal-mounted display unit is fitted diagonally in a case is suppressed and the electrical connection of the terminals is secured.

The invention provides an electronic timepiece comprising a liquid crystal panel, an electroluminescence panel provided on a rear surface of and adapted to illuminate the liquid crystal panel, electric terminals one end of each of which is electrically connected to a rear surface of the electroluminescence panel, and the other end of each of which is electrically connected to a circuit board, and a display unit housing holding the liquid crystal panel and electroluminescence panel therein, and having guide holes for inserting the electric terminals thereinto and retaining the same therein, the guide holes in the display unit housing having bores thereunder the diameter of each of which is larger than that of each of the guide holes so as to prevent a force exerted on the electric terminals when the electric terminals are inserted into the guide holes during an operation for diagonally fitting the display unit housing into a case with the liquid crystal panel, electroluminescence panel and electric terminals in a firmly combined state from causing the electric terminals in the mentioned state inserted into the display unit housing to slip in a horizontal direction.

By providing the bores, slippage of the electronic terminals in the horizontal direction when the display housing is fitted diagonally in the case is prevented.

The invention also provides an electronic timepiece, in which β is assumed to be an angle at which each of the electric terminals of a length L1 and an outer diameter D1 falls in the relative guide hole, which has a length L2 and a diameter D2, when the display unit housing is fitted in the case diagonally at an angle α, a diameter D3 of the bore then having the following relation to the other sizes.

$$D3=D2+2\times(L1-\sqrt{((L2)2+(D2-D1)2)})\times(\sin\beta+\tan\alpha\times\cos\beta)$$

$$\beta=\mathrm{TAN}^{-1}((D2-D1)/L2)$$

Since the bores have the above-described relation to other parts, the bores have not to be enlarged to a level higher than a required level.

The invention further provides an electronic timepiece, in which the liquid crystal panel is a film liquid crystal panel, the film liquid crystal panel being connected to the circuit board by film-like materials, the film-like materials by which the film liquid crystal panel and circuit board are connected together having a plurality of different lengths.

The invention furthermore provides an electronic timepiece which is an electronic timepiece using a display unit housing which retains electric terminals of coiled springs which electrically connect an EL panel to a driving circuit, each of guide holes for the electric terminals being formed so that the guide hole has at a driving circuit-side portion thereof a tapering bore a diameter of which is set to a level determined on the basis of an angle at which the electric terminal of the coiled spring diagonally contacts the driving circuit when the display unit housing is diagonally fitted in a case.

BRIEF DESCRIPTION OF THE DRAWINGS

A preferred embodiment of the invention will now be described with reference to the accompanying drawings wherein.

DETAILED DESCRIPTION OF THE PREFERRED EMBODIMENT

A preferred mode of embodiment of the electronic timepiece according to the present invention will now be described in detail with reference to the drawings.

Figure 1A:
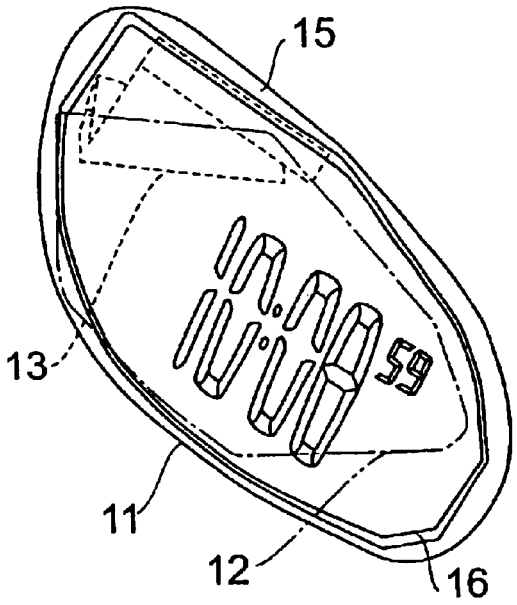
FIG. 1 are a general plan view and a sectional view of the present invention.
Figure 1B:
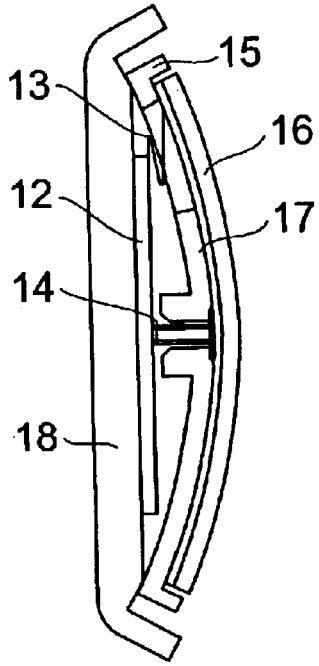

FIG. 1 are a general plan view 1A and a sectional view 1B of the electronic timepiece according to the present invention. The electronic timepiece according to the invention has a film liquid crystal panel 16, an EL panel 17 and electric terminals 14 of coiled springs all of which are held in a display unit housing 15. The film liquid crystal panel 16 is provided with the EL panel 17 on the rear side thereof. The film liquid crystal panel 16 is electrically connected to a driving circuit 12 provided on the rear side thereof, by a heat seal 13. The EL panel 17 is used as a back light for the liquid crystal panel 16. Each of the electric terminals 14 of coiled springs is engaged at one end thereof with a rear surface of the EL panel 17, and at the other end thereof with the driving circuit 12. Each electric terminal 14 of coiled spring is inserted into a two-stage through bore provided in the display unit housing 15. In order that the electric terminal 14 of coiled spring does not fall from the display unit housing 15, the diameter of the portion of the through bore which is on the side of the EL panel 17 is set larger. The outer diameter of a part of the electric terminal 14 of coiled spring is increased so that the mentioned part of the electric terminal is fitted closely in the diameter-increased part of the through bore. The electric terminal 14 of coiled spring is then sandwiched between the EL panel 17 and display unit housing 15 and thereby held firmly. The display unit housing 15 (which will hereinafter be referred to as "display module"), in which the film liquid crystal panel 16 is provided, and circuit board 12 are fixed to a case. During the fixing of the display module to the case 18, the driving circuit 12 is secured to the case first by screws.

Figure 2:
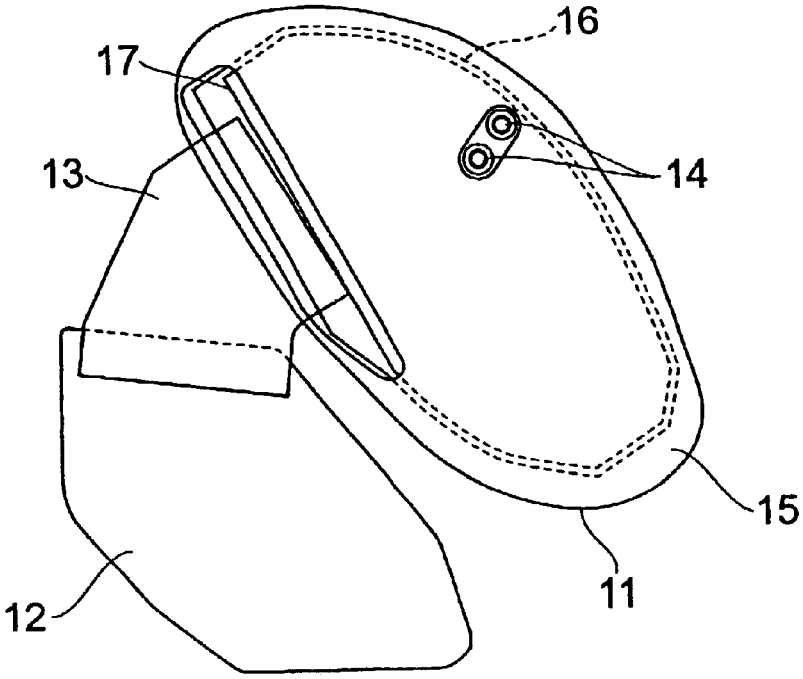
FIG. 2 is an expansion plan of a display module in the present invention.

FIG. 2 is an expansion plan showing the heat seal, display unit and driving circuit, which are arranged in a plane, in the electronic timepiece according to the present invention. The driving circuit 12 and display unit housing 15 are joined to each other by a part shaped so that the heat seal 13 thereof is partly shortened in conformity with the design of the case 18.

Figure 3:
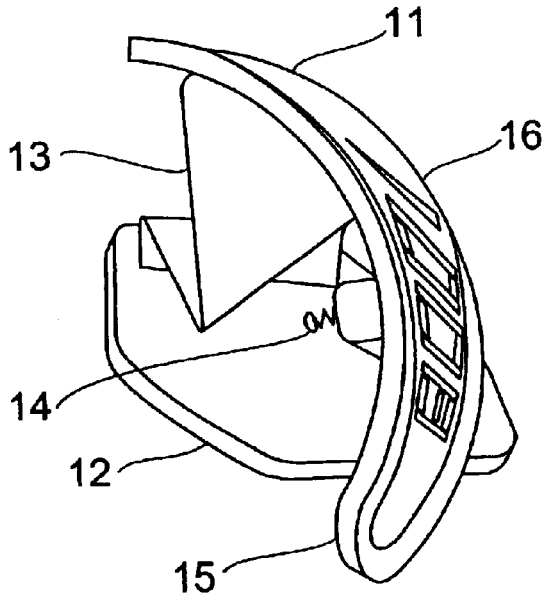
FIG. 3 is a drawing showing a display unit housing being diagonally fitted in a case in the present invention.

FIG. 3 is a drawing showing the display unit housing diagonally fitted in a case in the electronic timepiece according to the present invention. In order to fit the display unit housing 15 into the case 18, it is necessary that a longer portion of the heat seal 13 be folded. Therefore, the display unit housing 15 is fitted into the case as the display unit housing is inclined. During this time, the electric terminals of coiled springs are deformed axially, and a diagonal force is also exerted thereon. As a result, the electric terminals of coiled springs are moved in the through bores of the display housing 15 in a direction as well which is different from the axial direction. The detailed behaviors of the electric terminals will be described with reference to FIG. 4.

Figure 4:
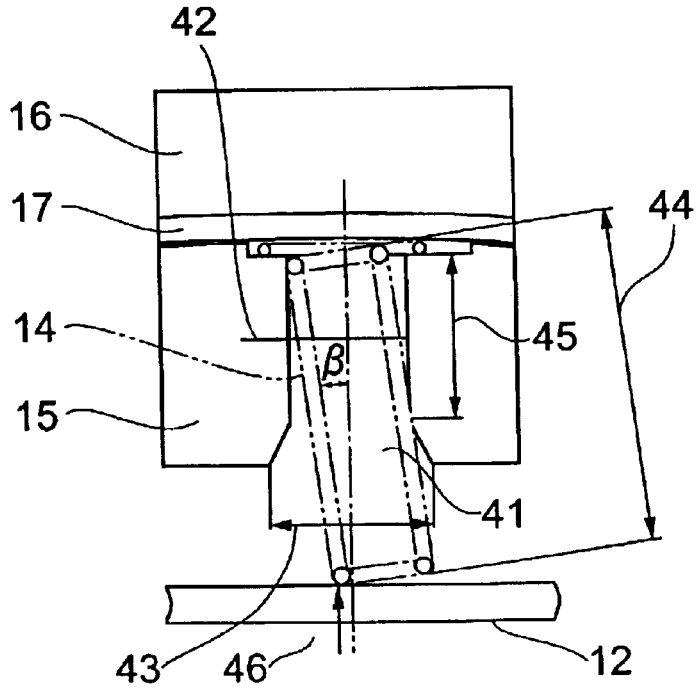
FIG. 4 is a detail drawing showing an electric terminal of a coiled spring in the present invention.
Figure 5:
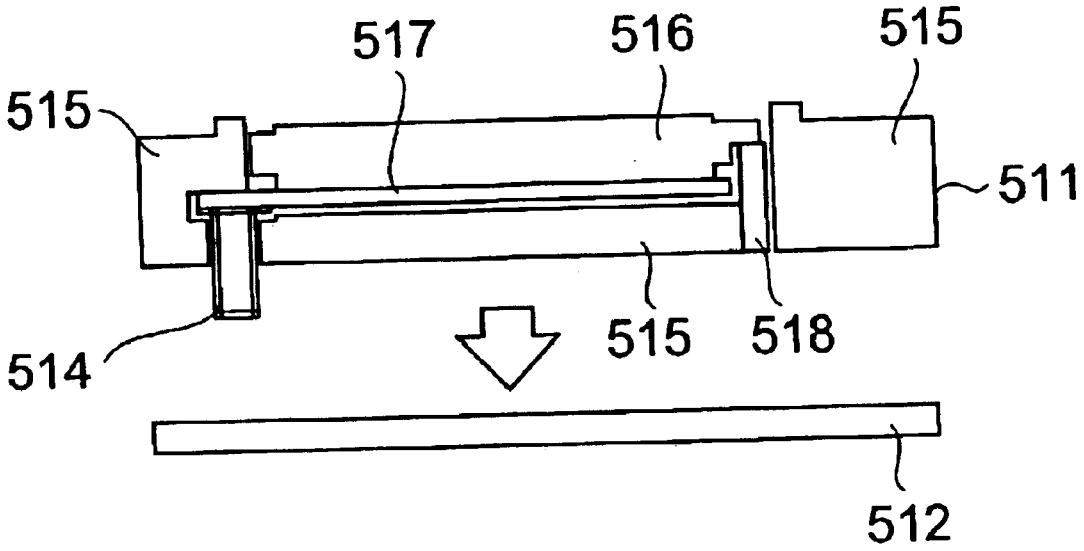
FIG. 5 Prior Art
FIG. 5 is a construction diagram of a related art electronic timepiece.

FIG. 4 is a detail drawing of an electric terminal 14 of coiled spring in the condition in which the display unit housing 15 of FIG. 3 is diagonally fitted in the case. The display unit housing fitting operation is started by inclining the display unit housing 15 at an angle of α degrees from the horizontal, and further put forward. Finally, the display unit housing 15 in an inclined state becomes horizontal. During this time, a load is imparted on the electric terminal 14 as well first at an angle of a degrees from the vertical so as to diagonally compress the coiled spring. The spring compressing angle decreases gradually, and becomes zero degree finally, so that a load is imparted to the coiled spring in the vertical direction. Let D1 equal an outer diameter 41 of an electric terminal 14 of coiled spring, D2 a diameter 42 of a guide hole for the electric terminal of coiled spring in the display unit housing 15, D3 a diameter of the portion of a tapering opening 43 of the guide hole in the display unit housing which is on the side of the driving circuit, L1 the length 44 of the coiled spring, L2 the length 45 of the guide hole for the electric terminal of coiled spring of the display unit housing 15, and α degrees an angle of a flexure load imparted to the coiled spring when the display unit 11 is diagonally fitted into the case. Then, the D3, the diameter of the portion of the tapering opening 43 of the guide hole in the display unit housing which is on the side of the driving circuit is determined by the following equations. In this equation, β represents an angle at which each of the electric terminals of coiled springs falls in the relative guide hole in the display unit housing when a force of an angle α is exerted to the same electric terminal.

$$D3=D2+2\times(L1-\sqrt{((L2)2+(D2-D1)2)})\times(\sin\beta+\tan\alpha\times\cos\beta) \quad \text{(Equation 1)}$$

$$\beta \mathrm{TAN}^{-1}((D2-D1)/L2) \quad \text{(Equation 2)}$$

When a compressive load starts being imparted at an angle of a degrees to the electric terminal of coiled spring in the guide hole in the display unit housing in which the diameter of the portion of the tapering bore of the guide hole which is on the side of the driving circuit is set to D3, the coil spring is deformed within a contour in plan of the tapering opening of the diameter D3. When an angle of inclination of the display unit housing being fitted in the case decreases gradually from an angle of a horizontal state to zero degree via the angle of α degrees with an undue horizontal load which is imparted to the coiled spring in the display unit housing existing, if any, the coiled spring can be released from the undue load without being caught by the guide hole for the coiled spring. This enables the slippage of the portion of the coiled spring which is in a position of the horizontal of the free end thereof on the side of the driving circuit to be minimized.

Although an example using a film liquid crystal panel as the liquid crystal panel has been described above, a liquid crystal panel using a glass board may also be employed.

In the electronic timepiece according to the present invention formed as described above, tapering bores are provided in the guide holes of the display unit housing. Therefore, when the display unit housing mounted with the electric terminals inserted into the guide holes is fitted diagonally into the case, the openings allow the behavior of the electric terminals in the housing fitting operation. This enables the slippage of the horizontal position of the electric terminals to be minimized. Since the horizontal slippage of the electric terminals can be minimized, the degree of freedom of setting the positions of the terminals of the film liquid crystal panel and EL panel increases, and an electronic timepiece having a case of a further improved design can be provided.

What is claimed is:

1. An electronic timepiece comprising:

a liquid crystal panel, an electroluminescence panel provided on a rear surface of and adapted to illuminate the liquid crystal panel, electric terminals one end of each of which is electrically connected to a rear surface of the electroluminescence panel, and the other end of each of which is electrically connected to a circuit board, and a display unit housing holding the liquid crystal panel and electroluminescence panel therein, and having guide holes for inserting the electric terminals thereinto and retaining the same therein, wherein the guide holes in the display unit housing have bores thereunder the diameter of each of which is larger than that of each of the guide holes so as to prevent a force exerted on the electric terminals when the electric terminals are inserted into the guide holes during an operation for diagonally fitting the display unit housing into a case with the liquid crystal panel, electroluminescence panel and electric terminals in a firmly combined state from causing the electric terminals in the mentioned state inserted into the display unit housing to slip in a horizontal direction.

2. An electronic timepiece according to claim 1, wherein, β is assumed to be an angle at which each of the electric terminals of a length L1 and an outer diameter D1 falls in the relative guide hole, which has a length L2 and a diameter D2, when the display unit housing is fitted in the case diagonally at an angle α, a diameter D3 of the bore under the guide hole then having the following relation to the other sizes.

$$D3=D2+2\times(L1-\sqrt{((L2)2+(D2-D1))2})\times(\sin\beta+\tan\alpha\times\cos\beta)$$

$$\beta-\mathrm{TAN}^{-1}((D2-D1)/L2).$$

3. An electronic timepiece according to claim 1, wherein the liquid crystal panel is a film liquid crystal panel, the film liquid crystal panel being connected to the circuit board by film-like materials, the film-like materials by which the film liquid crystal panel and circuit board are connected together having a plurality of different lengths.

* * * * *